United States Patent [19]

Snyder et al.

[11] 3,938,490

[45] Feb. 17, 1976

[54] INTERNAL COMBUSTION ENGINE IGNITION SYSTEM FOR GENERATING A CONSTANT IGNITION COIL CONTROL SIGNAL

[75] Inventors: Larry D. Snyder, San Jose; Robert B. Hood, Los Altos, both of Calif.

[73] Assignee: Fairchild Camera and Instrument Corporation, Mountain View, Calif.

[22] Filed: July 15, 1974

[21] Appl. No.: 488,883

[52] U.S. Cl. ..... 123/148 E

[51] Int. Cl.[2] ..... F02P 1/00

[58] Field of Search ..... 123/148 E; 307/260

[56] References Cited

UNITED STATES PATENTS

| | | | |
|---|---|---|---|
| 3,569,843 | 3/1971 | Meyer | 307/260 |
| 3,741,176 | 6/1973 | Schmidt | 123/148 E |
| 3,749,070 | 7/1973 | Olshi et al. | 123/148 E |
| 3,828,751 | 8/1974 | Adams | 123/148 E |
| 3,831,571 | 8/1974 | Weber | 123/148 E |

*Primary Examiner*—Wendell E. Burns
*Assistant Examiner*—James W. Cranson, Jr.
*Attorney, Agent, or Firm*—Alan H. MacPherson; Henry K. Woodward; J. Ronald Richbourg

[57] ABSTRACT

An ignition system for use with an ignition coil and a source of alternating distributor pickup signals within an internal combustion engine. The system includes a zero crossing detector responsive to the distributor pickup signals and operative to generate a first timing signal, a complex ramp generator responsive to the first timing signal and operative to generate a second timing signal, a gate responsive to the first and second timing signals and operative to generate a constant ignition coil control signal over the normal operating range of the engine, and an output amplifier responsive to the control signal and operative to control charging and discharging of the ignition coil. A voltage control circuit is employed to switch the output amplifier on when the voltage at the ignition coil exceeds a predetermined value.

10 Claims, 8 Drawing Figures

INTERNAL COMBUSTION ENGINE IGNITION SYSTEM FOR GENERATING A CONSTANT IGNITION COIL CONTROL SIGNAL

BACKGROUND OF THE INVENTION

1. Field of the Invention

This relates generally to internal combustion engine ignition systems and in particular, to an automotive ignition system that generates a constant ignition coil control signal over the normal range of operation of the engine.

2. Description of the Prior Art

An ignition system is utilized in internal combustion engines to provide ignition sparking potential to the spark plugs. The conventional ignition system commonly used today uses breaker points to periodically interrupt a current in the primary of an ignition coil. When the points are separated by, for example, the distributor camshaft, the current then flowing through the primary of the ignition coil decreases rapidly, inducing a high voltage in the coil secondary which is selectively connected via the distributor to an appropriate spark plug. At the spark plug, the high induced voltage ionizes the gap between electrodes which causes a compressed air/fuel mixture associated with the cylinder to ignite.

Although widely used, the conventional system is subject to variations in spark intensity and timing over the system lifetime due to combinations of the following factors: unpredictability of the rate of decrease of current in the primary due to variations in the arc formed at the contact regions of the points; changes in the current in the coil just before it is interrupted due to changes in resistance when the breaker points are closed; changes in ignition timing accuracy relative to crankshaft position due to mechanical wear of the cam follower and other components; changes in signal due to "point bounce" which is a form of harmonic motion set up by the points under certain speed/acceleration conditions; changes in the mechanical and electrical characteristics of the breaker points due to electrical, chemical, and mechanical stress; and wide variations in coil primary current due to changes in vehicle battery voltage, the series resistances in the coil primary current path, the ambient temperature, and the resistance of the breaker points.

Each of these factors affect the peak output voltage of the coil, and consequently the voltage presented to the spark plug. As a result the sensitivity of the system to changes in spark plug gap ionization potential is increased over its lifetime, which, in turn, causes a decrease in the effective spark plug life. It has been found that as plugs age, their tendency to misfire increases. Misfire adversely affects performance, economy and emissions output of the engine.

One type of automotive ignition system is limited to using a distributor magnetic pickup voltage waveform to establish on and off times of current through the primary winding of the ignition coil. To compensate for cycle-to-cycle error in the continuously varying pickup voltage, the system employs a feedback signal which is generated during one cycle of operation and used to control current generation in succeeding cycles. However, the system does not provide the degree of control desired with magnetic pickups which exhibit cycle-to-cycle errors.

Other types of ignition systems are found in U.S. Pat. No. 3,238,416 issued Mar. 1, 1966, and entitled "Semiconductor Ignition System" by G. D. Huntzinger et al., U.S. Pat. No. 3,487,822, issued Jan. 6, 1970, and entitled "Capacitor Discharge Ignition System", by A. G. Hufton et al., U.S. Pat. No. 3,605,713, issued Sept. 20, 1971, and entitled "Internal Combustion Engine Ignition System", by P. D. LeMasters et al., and in copending U.S. continuation patent application Ser. No. 419,172, filed Nov. 26, 1973, and entitled "Automotive Ignition Control," by A. A. Adamian et al.

SUMMARY OF THE PRESENT INVENTION

In accordance with this invention an ignition system for use with an ignition coil and a source of alternating distributor pickup signals within an internal combustion engine is disclosed. The system includes a zero crossing detector responsive to the distributor pickup signals and operative to generate a first timing signal, a complex ramp generator responsive to the first timing signal and operative to generate a second timing signal, a gate responsive to the first and second timing signals and operative to generate a constant ignition coil control signal over the normal operating range of the engine, and an output transistor responsive to the control signal and operative to control charging and discharging of the ignition coil. In addition, a voltage control circuit is employed to switch the output transistor on when the voltage at the ignition coil exceeds a predetermined value.

Among the advantages of the present invention is that the system is insensitive to variations in the wave form of the distributor pickup voltage.

Another advantage of the present invention is that information relative to the actual engine speed is derived from the previous zero crossing of the input wave form and used to develop an accurate control voltage for application to control the initiation of current through the primary winding of the ignition coil.

Still another advantage of the present invention is that the system provides an active circuit for limiting the maximum current in the primary winding of the ignition coil.

Still another advantage of the present invention is that the maximum voltage and power dissipation is controlled while energy levels are maintained.

Other advantages will be apparent to those skilled in the art having read the following detailed disclosure which makes reference to the several figures of the drawings.

IN THE DRAWING

FIG. 1 illustrates a generalized schematic block diagram of the internal combustion engine ignition system in accordance with the present invention.

FIGS. 2, 2*a* and 2*b* illustrate a detailed schematic diagram of the ignition system of FIG. 1.

DETAILED DESCRIPTION OF THE PREFERRED EMBODIMENT

Figure 1:
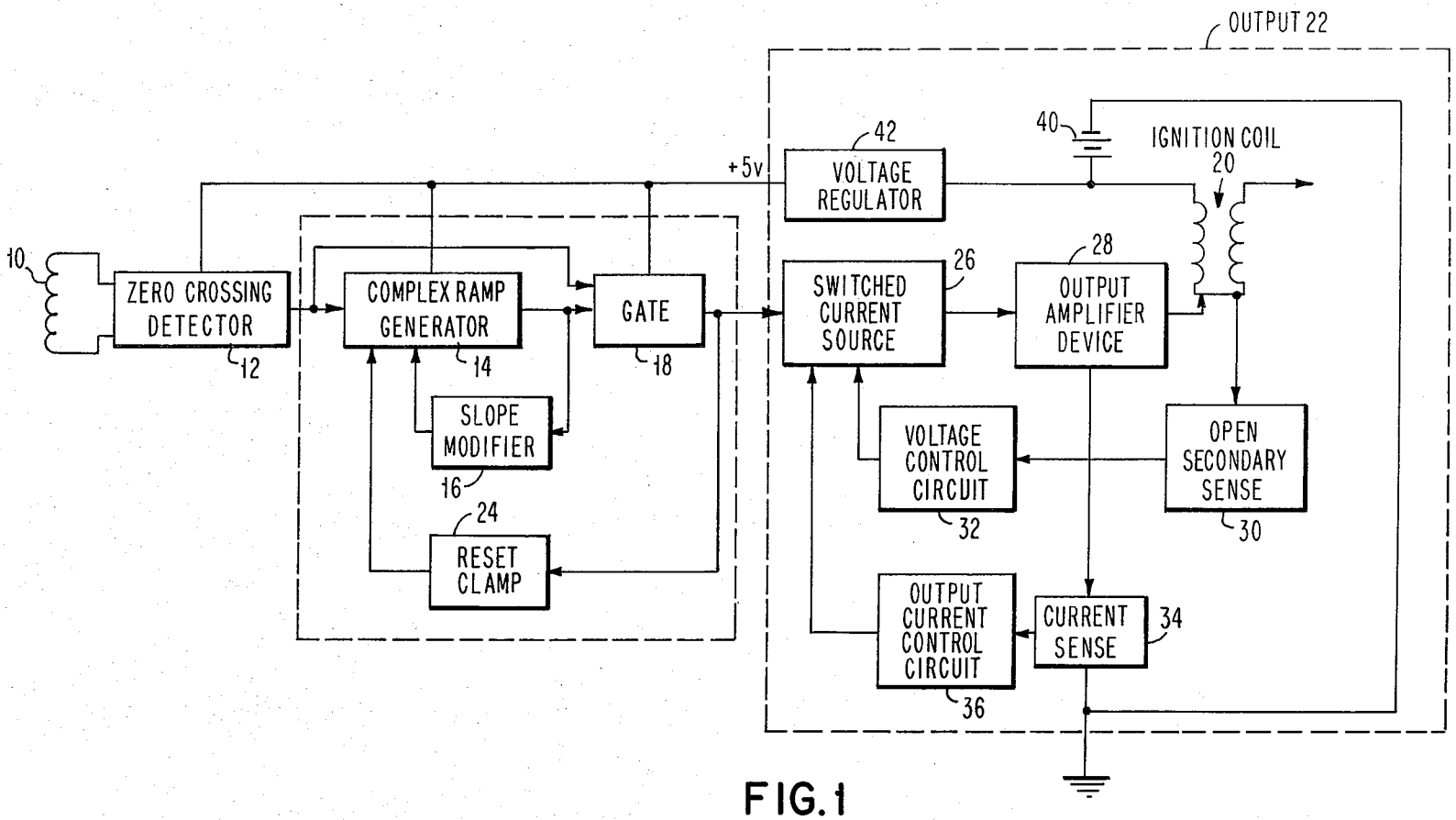

In FIG. 1 of the drawings, the preferred embodiment of the internal combustion engine ignition system of this invention is set forth in a block diagram. The ignition system comprises a distributor pickup coil 10, a zero-crossing detector 12, a complex ramp generating means 14, or ramp generator, which is electrically connected to the zero-crossing detector 12, slope modifier circuitry 16 connected in a feedback loop with the output terminal of the ramp generator 14 for controlling the output wave form of the ramp generator, and a gate 18 which is electrically connected to the zero-crossing detector 12 and to the complex ramp generator 14 for providing a dwell signal which drives an ignition coil 20 in an output circuit 22. A clamping circuit 24 connected in a feedback path between the output terminal of gate means 18 and the complex ramp generator 14 resets the complex ramp generator 14 during each ignition cycle. The output circuit 22 includes a switched constant current source 26, and a power output amplifying device 28 serially connected between constant current source 26 and a primary winding of the ignition coil 20 for amplifying the current applied to the ignition coil. An open secondary sense circuit 30 and a voltage control circuit 32 are connected in a feedback path between the ignition coil 20 and the switched current source 26 for controlling operation of the switched current source 26 when an open circuit is detected in the secondary winding of the ignition coil, and a current sense circuit 34 and a power amplifier control circuit 36 are connected in a feedback loop between the output amplifying device 28 and the switched constant current source 26 for controlling operation of the current source 26 as a function of current through the output device 28.

A battery 40 is connected to one end of the primary winding of the ignition coil 20 and provides a source of direct current voltage. A voltage regulator 42 is serially connected between the battery 40 and several of the circuit elements so as to provide a stable controlled direct current voltage to these elements for all ranges of battery voltage variations.

Figure 2:
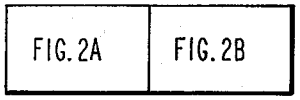
Figure 2A:
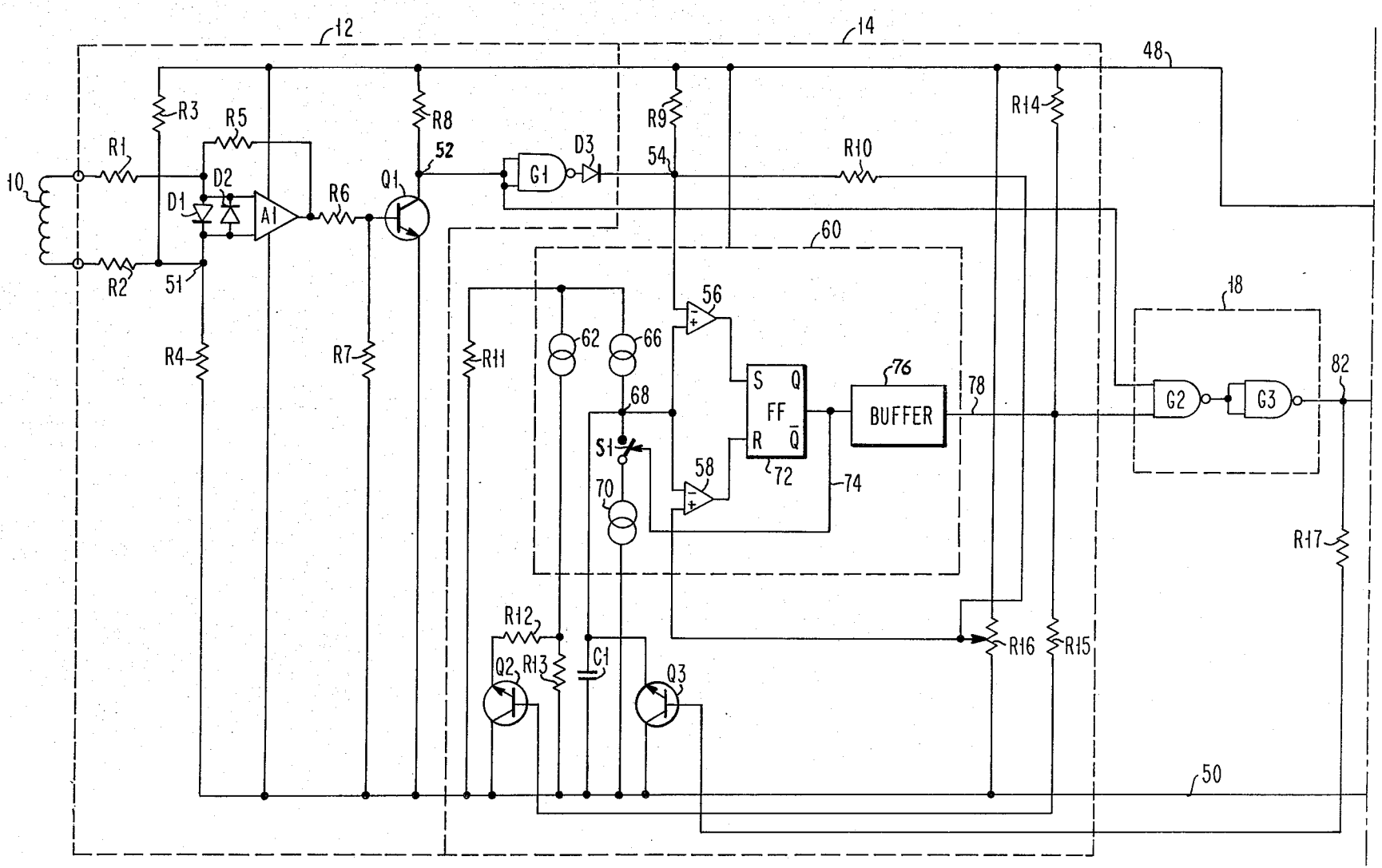
Figure 2B:
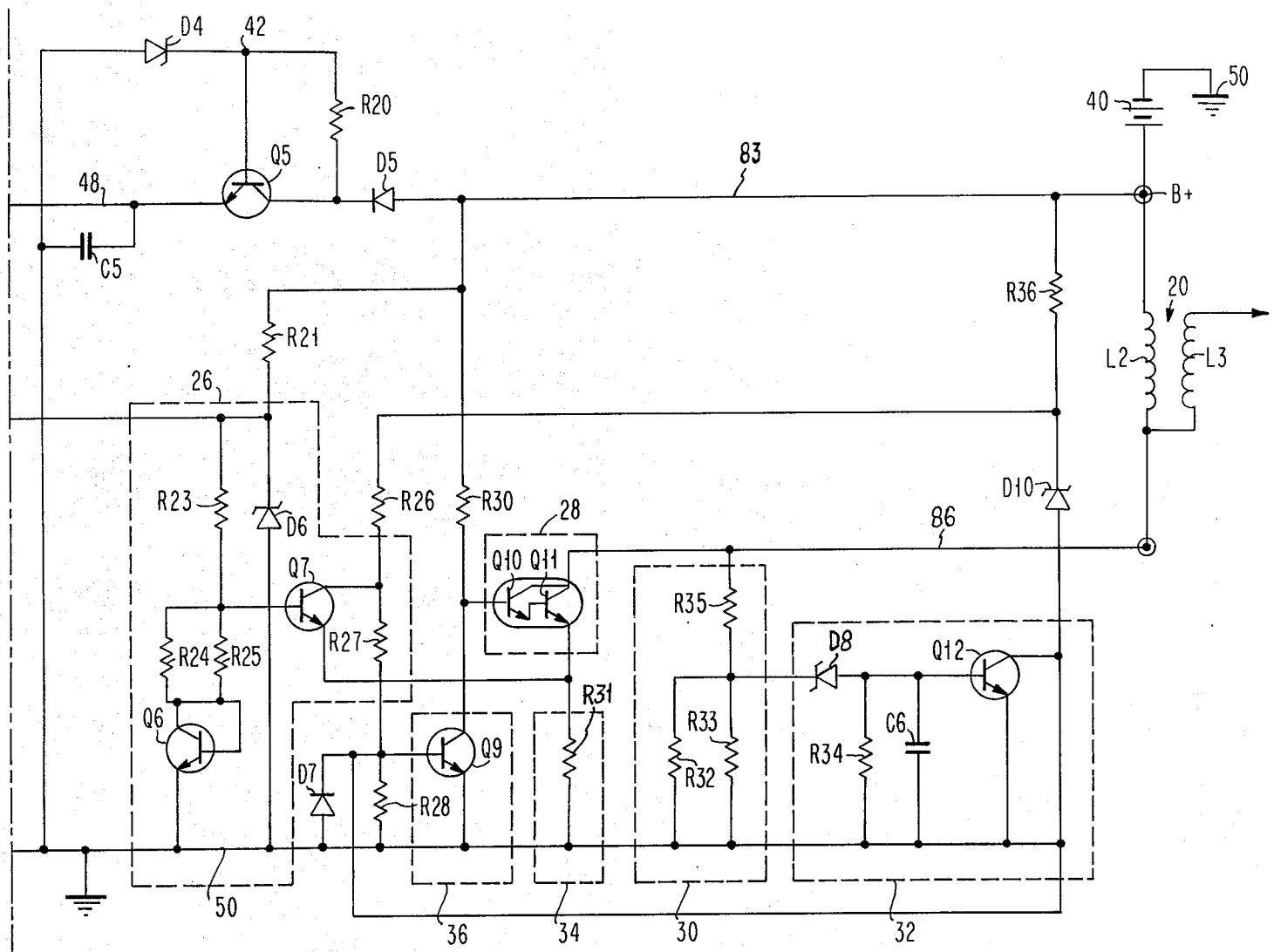

Referring now to FIG. 2 of the drawings, a detailed schematic diagram of the preferred embodiments of the ignition system of FIG. 1 is illustrated. It would be noted in the description that follows, a transistor is denoted by the letter Q followed by a number, transistors connected as diodes are designated by the letter Q followed by a number, a resistor by the letter R followed by a number, and other types of components by an identifying letter, such as C for a capacitor and D for a diode, followed by a number. Nodal points within the circuit and conductors are designated solely by a number.

The distributor pickup coil 10 comprises the low voltage circuitry of the distributor. For example, in an 8-cylinder, 4-cycle engine, distributor pickup coil 10 produces 8 electrical output pulses for every two complete rotations of the engine crankshaft. The particular wave form of the signal developed across pickup coil 10 is specified to the engine requirements. The distributor pickup voltage is illustrated in FIG. 5A. As illustrated therein, the voltage is an alternating voltage that is substantially cyclical, having a negative polarity over 30 percent of the cycle and a positive polarity over the remaining 70 percent of the cycle. The amplitude of the distributor pickup voltage is proportional to engine speed and, varies from approximately 50 millivolts peak-to-peak when the engine is being turned by the battery prior to starting, to about 100 volts peak-to-peak, when the engine is running at about 6000 revolutions per minute.

The zero-crossing detector 12 comprises input resistors R1 and R2 which are serially connected between the opposite sides of the distributor pickup coil and an operational amplifier A1 and serve to reduce the voltage appearing at the input of the operational amplifier and to decrease the electrical loading of the pickup coil. Biasing resistors R3 and R4 are serially connected between a conductor 48, which carries the 5 volt regulated DC voltage, and circuit ground, which is illustrated by the conventional symbol for ground and designated by the numeral 50. The common junction between R3 and R4 is designated as node 51 and is connected in common with the input terminal of A1 that is joined to R2 and serves to bias the operational amplifier. Diodes D1 and D2 are connected across the input terminals of operational amplifier A1 with the cathode of D1 and the anode of D2 connected to node 51. The diodes clamp the input of operational amplifier A1 to protect the amplifier from high distributor pickup voltages, which occur when the engine is running at high speeds (and from high externally applied voltages.) Feedback resistor R5 is connected between the output terminal of amplifier A1 and resistor R1 and provides positive feedback to the input of A1 so as to insure that the operational amplifier operates in a saturated mode. Resistor R5 is designated in the art as a hysteresis resistor.

Functionally, the zero-crossing detector 12 converts the alternating input wave form applied to R1 and R2 into a first timing signal which comprises either of two logic states; a logical one if the input wave form is above a zero reference level, and a logical zero if the input wave form is below a zero reference level. Because the operational amplifier is operated in the saturated mode, distributor pickup signals of relatively small magnitude and of either polarity are effective to overpower the amplifier input, causing the logical output signals to switch states as the pickup signals pass through a zero crossing. Since only the zero crossings are utilized in developing a dwell signal, this ignition circuit is insensitive to most variations in the wave form of the distributor pickup voltage. It should be recognized that the signal appearing at the output of the operational amplifier is inverted with respect to the distributor pickup voltage.

In the preferred embodiment resistors R1 and R2 are 20K ohms, resistors R3 and R4 are 1K ohms and resistor R5 is 1 megohm. The operational amplifier is one similar to that designated as Model 776 and manufactured by the Fairchild Camera and Instrument Corporation assignee of this invention. Accordingly, node 51 is biased at approximately 2.5 volts, and insures that the operational amplifier, A1, is biased within its operative range.

The output signal of the operational amplifier is applied through a serially connected interfacing resistor R6 to the base of an inverting transistor amplifier Q1. Bias resistor R7 connected between ground and the base of Q1 forms a voltage divider network with R6. The emitter of transistor-amplifier Q1 is grounded. A load resistor R8 is connected between bias conductor 48 and the collector of Q1, which is designated as node 52. Accordingly, when amplifier A1 is conducting the base to emitter junction of Q1 is forward biased, causing Q1 to conduct and applying the nearly zero volt ground potential on node 52. Similarly, if A1 is nonconducting then Q1 is also non-conducting and the regulated five volt bias voltage present on 48 is conducted through R8 to diode 52. Because of the two inverting stages (A1 and Q1), the voltage on node 52 is of the same polarity as the distributor pickup voltage and represents the output signal from the zero crossing detector 12. The wave form of this voltage is illustrated in FIG. 5B.

The voltage level on node 52 is conducted to one of the two input terminals of gate 18 and is also applied to the input of an inverter gate G1. The output of gate G1 is applied to the anode electrode of diode D3 which conducts only positive signals. A conductor connected to the cathode of D3 serves as one of the input terminals of the zero-crossing detector means 12 and is designated as node 54.

A voltage divider network comprising serially connected resistors R9, R10 and potentiometer R16 is connected between conductor 48 and ground 50. Node 54, the junction between resistors R9 and R10 is connected by a conductor to a first input terminal of a comparator 56 so as to apply a high reference voltage thereto. R16 serves as a threshold setting potentiometer and its wiper is connected to an input terminal of a second comparator circuit 58 so as to apply a low reference voltage thereto. The terminals of potentiometer R16 are connected between the conductors 48 and 50 such that the entire bias voltage is applied across the potentiometer resistor R16. In the preferred embodiment R9 is 1 megohm, R10 is 24K ohms, and R16 is 1K ohms.

Comparators 56 and 58 comprise a portion of the complex ramp generating means 14 and are included in a module, designated by the numeral 60. Module 60 is preferably the Fairchild Model 7360 Dual Ramp Generator. The module 60 includes a first controlled current source 62 that is interconnected between an input terminal 64 and one side of resistor R13. R13 comprises a portion of an external resistive network. The resistance of this external network determines the slope of the ramp and will be subsequently described in more detail. A second controlled current source 66 is serially connected between input terminal 64 and a first terminal 68 of semiconductor switch S1. A second terminal of switch S1 is connected to one terminal of a third controlled current source 70, its other terminal being grounded.

Resistor R11 is connected between input terminal 64 and ground and supplies the appropriate bias for the controlled current sources 62, 66 and 70. A ramp generating capacitor C1 is connected between terminal 68 and ground. The current sources 62, 66 and 70 provide current in the appropriate direction to develop the complex ramp voltage across C1 which appears on terminal 68 and which is converted into the output dwell signal used to drive the ignition coil. Terminal 68 is also connected to an input terminal of the first and second comparator networks 56 and 58, respectively, so as to apply the complex ramp voltage thereto for comparison with the high and low reference voltages, respectively. The output terminal of comparator 56 is connected to the S input of RS flip-flop 72 and the output terminal of comparator 58 is connected to the R input terminal of flip-flop 72. The set output terminal of flip-flop 72 is applied through conductor 74 to energize switch S1 and also through a buffer network 76 to an output terminal 78. The buffer network 76 serves to provide the appropriate impedance levels to the following stages of the ignition circuit. The flip-flop 72 provides a memory for the ramp generator module which records and memorizes the direction in which the currents are flowing through capacitor C1.

Conductor 78 is connected to the second input terminal of gate means 18. The gate means 18 comprises serially-connected inverting gates G2 and G3 which are arranged as a two-input AND gate. Accordingly, when the first timing signal applied on the first input terminal from node 52 of the zero crossing detector and the second timing signal applied on the second input terminal 78 are both in the high condition, the output of the AND gate appearing on terminal 82 will similarly be high. The output terminal 82 of gate means 18 is connected in a feedback path through resistor R17 to the base of transistor Q3. The collector of Q3 is connected to ground and the emitter is connected to terminal 68 of capacitor C1. Thus, when the output of the gate 18 is high, base drive current is applied to Q3, turning the transistor on in the inverse conduction mode and pulling the terminal 68 at the output of C1 to approximately ground potential. Accordingly, C1 is reset to its initial zero voltage condition except for saturation offsets in the transistor Q3.

The slope modifying network 16 (See FIG. 1) interconnects the output terminal 78 and an input terminal of one of the controlled current sources 62 of the ramp generator module 60 and comprises a resistor R15 connected to the base of switching transistor Q2. The emitter of Q2 is connected through resistor R12 to one side of resistor R13. The other side of R13 and the collector of Q2 are connected to ground. A resistor R14 is connected between the five volt DC conductor 48 and conductor 78 so as to appropriately bias the output terminal. Accordingly, when the output signal of the ramp generating module is positive, base drive current is applied through R15 to turn on transistor Q2. Consequently, when Q2 is on, the external resistance connected to the controlled current sources 62, 66 and 70 is the parallel combination of R12 and R13, which is necessarily lower than the resistance of R13. However, when Q2 is in the non-conducting state, the external resistance is the value of R13 only. The external resistance network is necessary because of the 30–70% alternating current pickup voltage wave form. The value of R12 is selected to insure that the slope of the complex ramp voltage will, if uninterrupted, intersect the 0 volt reference at the end of the cycle.

Figure 6:
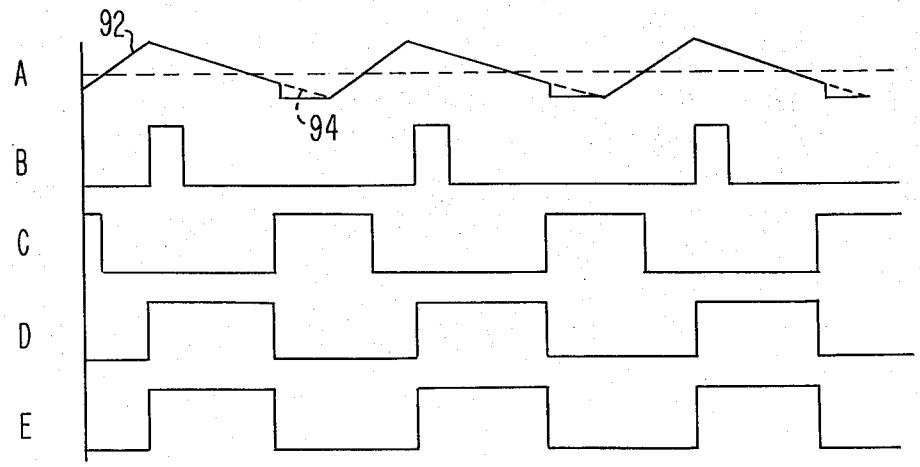

The operation of the ramp generating means 14 is described hereafter with reference to the wave forms illustrated in FIG. 6. FIG. 6A illustrates the complex ramp voltage across capacitor C1 that is present on terminal 68. The wave form includes an upward ramp, having a slope determined by the parallel resistance of R13 and R12, a downward ramp, having a slope determined by the resistance of R13, and a negative step to ground potential that occurs due to the clamping action of Q3 when the reset pulse is applied. The dotted line 92 represents the low reference voltage level applied to comparator 58. The dotted line 94 represents a continuation of the downward ramp and is shown to cross the zero reference base at the end of a cycle. Thus, for all constant engine speeds the modifier circuit insures that the cycle begins and ends at the zero reference base. It should be noted that by varying the slope, the threshold crossing time can be varied. Consequently, by appropriately selecting the resistances R12 and R13, this ignition circuit can be used for any cyclical alternating current distributor pickup voltage.

FIG. 6B illustrates the voltage wave form at the output of comparator 56. FIG. 6C illustrates the voltage wave form at the output of comparator 58. FIG. 6D illustrates the voltage wave form at the output of flip-flop 72. FIG. 6E has the same wave form as FIG. 6D and illustrates the voltage wave form at the output of the buffer circuit 76 that is present on conductor 78.

In operation, at the beginning of a typical engine cycle, switch S1 is open and current source 66 applies current I1 to C1 so as to develop a time increasing voltage thereacross. As the voltage on capacitor C1 ramps upwardly, the zero crossing detector changes state and the reference voltage 90 goes low (near voltage 92). Consequently, flip-flop 72 goes high causing the output wave form on conductor 78 (FIG. 6E) to switch to the low condition, turning off Q2. As Q2 turns off, R12 is disconnected from its parallel connection with R13 so as to extend the slope of the ramp. As previously mentioned, the slope of the upward ramp is determined by the parallel combination of R12 and R13, and the slope of the downward ramp is determined by the value of R13 alone. In addition to causing the output wave form on conductor 78 to go low, as flip-flop 72 goes high, it causes a voltage to be applied through conductor 74 to switch S1, thereby closing the switch. Once S1 is closed, current source 70 is connected in series with source 66. These sources supply a current that is of a greater magnitude and of opposite polarity than the current supplied by source 66. Thus, the current flowing through capacitor C1 reverses direction and accordingly, causes a downward or negative voltage ramp of the terminal 68 of capacitor C1.

The downward ramp continues until it reaches the lower reference threshold voltage 92 which is detected by comparator 58. At that time comparator 58 goes low, causing flip-flop 72 to reset, and consequently, the output appearing on conductor 78 goes high, again switching S1 and causing the slope on the ramp to begin a positive excursion.

It should be noted that the output of gate G1 is applied to the input of comparator 56. Thus, when gate G1 is low, the comparator output is low. When this condition occurs the voltage across C1 is forced to begin ramping negatively. On the other hand, when the output of gate G1 is high, the ramping voltage at the output of C1 may go positive or it may not. Since C1 is always forced to return to the same initial condition (approximately zero volts) for each cycle of operation, the ramp voltage is substantially instantaneous and does not comprise any long-term averaging affects.

Figure 5:
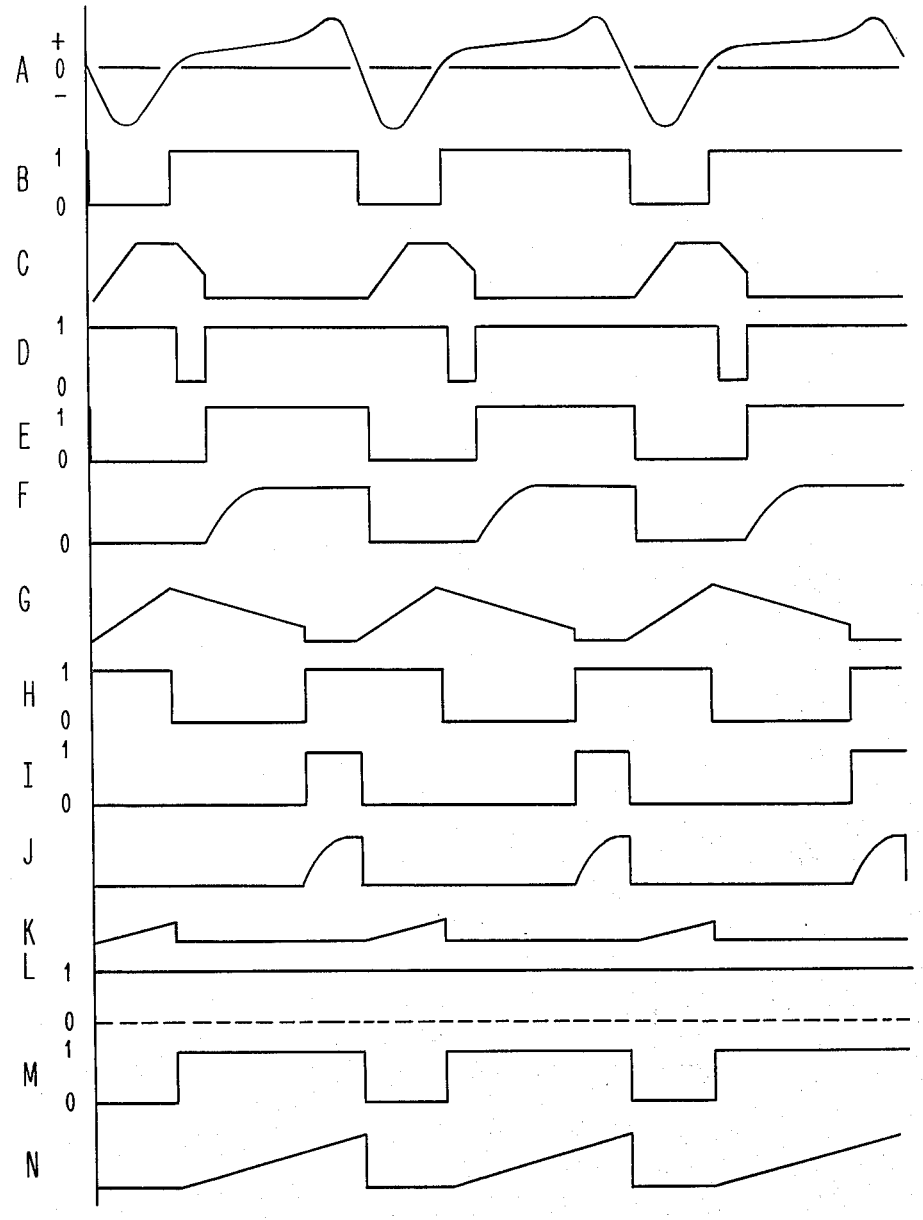
FIGS. 5 and 6 are timing diagrams illustrating the operation of the system shown in detail in FIG. 2.

It should also be recognized that because of the amplitude variation of the distributor pickup voltage with respect to engine speed, the ignition circuit of this invention employs several modes of operation. Referring to FIG. 5 several voltage wave forms are illustrated. As previously described FIG. 5A illustrates the distributor pickup voltage wave form. FIG. 5B illustrates the logical level of the zero crossing detector means 12. FIGS. 5C, D, E and F illustrate circuit conditions during a first mode of operation which occur when engine speed is in the cranking speed and about 500 engine revolutions per minute. In this mode the ignition coil remains ON for the maximum time.

FIGS. 5G, H, I and J illustrate circuit conditions during a second mode of operation which occurs when engine speed is in the approximate range between 500 and 1500 revolutions per minute. This range is the normal operating range of the engine and this mode is designated as the constant ON time mode since in this range the width of the control signal is constant.

FIGS. 5K, L, M and N illustrate circuit conditions during a third mode of operation which occur when engine speed is in the approximate range between 1500 and 6000 revolutions per minute. This mode is designated as the time proportioning mode which is further explained hereinbelow.

FIGS. 5C, G and K illustrate the voltage wave form of the complex ramp generator that appears across capacitor C1 and is present on terminal 68. It should be noted that the actual wave forms vary continuously with the engine speed and that the wave forms illustrated are selected as being representative of each particular mode of operation. However, in all modes of operation the slope of the ramp voltages is the same. FIGS. 5D, H and L illustrate the logic output state present on conductor 78 at the output of the complex ramp generating means 14. FIGS. 5E, I and M illustrate the output dwell signal present on terminal 82 at the output of gate means 18.

As illustrated, the ramp generator output has a logical one state during the time that the complex ramp voltage has a positive slope as in the case of FIG. 5H. The logical one state continues when the voltage maximum is reached, at which time the slope is zero as illustrated in FIG. 5C. Once the ramp voltage starts to decrease, the output switches to the logical zero state and continues in this mode until reset. After reset, the slope is zero whereupon the logical one state occurs. In FIG. 5L the output is continuously one, although the dependency upon the ramp voltage remains as described.

The dwell signal is a binary signal that switches from the logical 0 output state to the logical one output state at the time that C1 is reset to ground potential. The dwell signal returns to its logical 0 output state when C1 begins to ramp positively.

Referring again to FIG. 2, the output terminal 82 of the gate means 18 is connected to the input terminal of the switched current source 26 so as to provide an ignition coil control signal to the output stage. The direct current voltage source that supplies power to the output circuit 22 is designated by the numeral 40. It is understood that in a motor vehicle system the voltage source comprises a battery that is charged by a generator which can supply the ignition system of this invention when the battery is operating and the output voltage of the generator is greater than the battery voltage. The positive side of the battery B+ is connected with conductor 83. Biasing resistor R21 is connected between the conductor 83 and terminal 82 so as to establish a reference voltage for application to the switched current source. Conductor 82 is also connected through a biasing resistor network and a compensating transistor Q6 to ground. The biasing resistor network includes voltage dropping resistor R3 which is serially connected to one side of the parallel combination of resistors R24 and R25. The other side of R24 and R25 is connected to the common base and collector terminals of transistor Q6. The common junction between resistors R23, R24 and R25 are connected to the base of current amplifying transistor Q7. R24 serves as a base biasing resistor for Q7 and R25 is a trimming resistor which allows the base potential to be accurately set. A zener diode D6 is connected between conductor 82 and ground so as to maintain the reference voltage on terminal 82. A temperature compensation network comprised of Q6, R24 and 25 is provided to further insure that the base potential on Q7 does not vary due to temperature fluctuations. It should be noted that Q6 and Q7 are both NPN transistors.

The collector of Q7 is connected through serially connected resistors R26 and R36 to conductor 83 carrying the B+ voltage and through serially connected resistors R27 and R28 to ground. Conductor 83 is also connected through resistor R30 to the base of transistor Q10, and also to the collector of a grounded emitter transistor Q9. Transistors Q10 and Q11 are connected in a Darlington configuration which is well known in the art and may be either separate devices or single chip complex devices. The emitter electrode of Q11 is connected through bias resistor R31 to ground and to the emitter of Q7. A conductor 86 is connected to the collector of Q11 and is connected in common to one side of a primary winding L2 and a secondary winding L3 of the ignition transformer 20. The other side of the primary winding is connected to the positive terminal 83 of the battery. The other side of the secondary winding L3 is connected to coil harness circuitry that is external to the ignition system of this invention and is not shown.

The collector of Q7 is also connected to ground through serially connected bias resistors R27 and R28, the junction of these resistors being connected to the base of Q9. A diode D7 is connected across R28 to ground any negative signals present at the base of Q9. Functionally, Q9 serves to invert signals present at its base and to apply the appropriate voltage level to drive the Darlington transistor pair, Q10 and Q11. When Q7 turns on, the drive to the base of Q9 is shunted into the collector of Q7 and Q9 turns off. This causes the battery potential to be applied through R30 to the base of Q10, which turns on Q10 and Q11. Thus, output current is conducted through the output conductor 86 to the primary winding L2 of the ignition transformer 20. The wave form of the coil output currents are illustrated in FIGS. 5F, 5J and 5N. It should be recognized that the time that the coil conducts corresponds to the time that the dwell signal is in the logical 1 state for the three modes of operation.

From the circuit diagram, it is noted that the circuit elements L2, Q10 and Q11, R31, Q7 and Q9 are connected in a circuit loop. These elements coact to produce a constant current through the coil primary. As the coil current increases, the voltage across R31 increases, thereby decreasing the conduction of Q7. This tends to create a constant current in the coil winding L2 as illustrated in FIGS. 5F and 5J. As previously mentioned, the current through coil L2 continues for the duration of the dwell signal. As the signal on conductor 82 goes low, the potential on the base of Q7 drops, causing Q7 to turn off. Consequently, Q9 turns on, which causes Q10 to turn off. At the time that Q10 turns off, a spark is produced in the secondary winding L3 and the magnetic field in the coil L2 collapses. The spark produced has a magnitude of over 20,000 volts.

Another feature of this invention is a protective circuit for preventing open circuits in the secondary winding from destroying portions of the ignition system. For example, if there is a failure of the secondary winding L3 of the open circuit type, then the output of Q11 appearing on conductor 86 tends to increase to a very high value so as to provide a discharge path for the coil primary L2. If this were to occur, then the coil harness (not shown) in the secondary circuit, the distributor cap wires to the spark plugs (not shown), and the Darlington transistor pair Q10 and Q11, could be damaged. In addition, extremely high voltage arcs would be set up across the ignition coil. The coil protection circuit comprises the open secondary sense circuit 30 and the voltage control circuit 32. The open secondary sense circuit 30 comprises a voltage divider network including serially connected resistors R35 and the parallel combination of R32 and R33 connected between conductor 86 and ground. The cathode of a zener diode D8 is connected to the junction of resistors R33 and R35. Accordingly, voltage present on conductor 86 is attenuated before application to the zener diode D8. The anode of D8 is connected to the base of transistor Q12 and to a high frequency bias network which comprises resistor R34 in parallel combination with capacitor C6 and serves to shunt high frequency signal components to ground. The collector of Q12 is connected to the base of Q9. Thus, when the voltage across R32 exceeds the breakdown potential of D8, voltage is applied to the base of Q12, turning on Q12 and diverting current from the base of Q9. This allows Q9 to turn off. Once Q9 turns off, base current is applied to the base of Q10 through R30, turning on Q10 which tends to stabilize its output voltage on conductor 86. Functionally, the circuit comprising Q9, Q10, Q11 regulates the voltage applied to the coil L2, and acts to dissipate the energy stored in the coil primary. Resistor R32 is a trimmer resistor used to regulate the voltage appearing at the zener diode D8. The base-biasing circuit comprising R34 and Q6 has a short time constant, so as to enable Q12 to react quickly to open circuits appearing at the secondary.

In the preferred embodiment, R35 is 100K ohms and the resistance of R32 and R33 in parallel is approximately 6K. D8 has a breakdown potential of 9 volts. Thus, for example, if a 500 volt signal was present on conductor 86, 12 volts would be applied to breakdown the zener diode D8.

Still another feature of this invention is a circuit operative to protect the ignition circuit from selected high battery voltages. In this circuit, a zener diode D10 is connected between one of the terminals of resistor R36 and the collector of transistor Q12, which in turn is connected to the base of Q9. D10 preferably has a 30 volt breakdown potential. Accordingly, if the battery voltage exceeds approximately 30 volts, then the zener diode D10 is turned on causing a positive voltage to be applied to the collector of Q12 and to the base of Q9, turning on Q9. Once Q9 turns on, Q10 turns off and prevents system operation at high battery terminal (line 83) voltage, or under charging system malfunction. It is important to note that the direct connection from the collector of Q12 to the base of Q9 bypasses the switched current source, i.e., Q7, and forces the output appearing on conductor 86 off. In effect, this unique feature enables the system to be shut down without dependency upon other portions of the circuit.

The voltage regulator circuit 42 is connected to conductor 83 which carries the positive battery potential B+. A diode D5 is serially connected to conductor 83 to prevent negative potential from being conducted to the ignition circuit and prevents circuit malfunctioning in case the battery terminals are reversed. The cathode of D5 is connected to one terminal of a biasing resistor R20 and to the collector of transistor Q5. The base of Q5 is connected to the other terminal of R20 and to the cathode of zener diode D4. The anode of D4 is connected to ground. The emitter of Q5 is connected to conductor 48 and provides the regulated 5 volt DC bias voltage thereon. A bypass capacitor C5 is connected between the emitter of Q5 and ground. Preferably, D4 is a zener diode having a breakdown voltage of about 5.6 volts. This diode in conjunction with resistor R20 establishes the reference voltage of the voltage regulator.

Referring again to FIG. 5, in the first mode of operation, which begins with an ignition turn-off of the output amplifier device 28, the negative going distributor pickup signal drives the output of the zero crossing detector 12 to the logical zero state, which causes a positive ramp to be developed across C1. The ramp continues in the positive direction until it reaches an upper limit at a level approximately equal to the voltage of the regulated power supply. The voltage appearing across C1 remains clamped at this level until the next zero crossing of the distributor pickup voltage. As the distributor pickup voltage crosses zero and goes positive, the output of the zero crossing detector 12 is switched to the logical one state. Consequently, comparator 56 is activated, causing a pulse to be developed at the output of flip-flop 72 which is conducted on conductor 74 to activate switch S1. Accordingly, current source 70 provides current in the negative direction to be applied to capacitor C1, thereby commanding the beginning of a negative ramp voltage across C1. Simultaneously, with the initiation of the negative ramp, transistor Q2 is deactivated, thereby removing R12 from the circuit and causing a change in the slope of the ramp. With this modified slope, C1 ramps linearly downwardly until the low reference threshold voltage of comparator 58 is reached. Once this level is reached, comparator 58 changes state which forces the output of the ramp generator 14 to the logical one state, operates reset transistor Q2, and switches the output condition of gate G2 to the logical zero state. Inverting gate G3 then converts the output condition of gate G2 to a logical one condition which is applied on conductor 82 to the switched current source 26. Activation of the switched current source 26 drives the output device 28 into the on condition whereby current is supplied to the primary winding L2 of the ignition coil 20.

When the distributor pickup voltage next crosses the zero reference level in the negative-going direction (referred to as the ignition command), the state of the zero crossing detector 12 switches to the logical zero state which changes the logical condition of the output signals appearing at the gates G1, G2 and G3. As G3 changes its state, the current flowing through the primary winding L2 is interrupted, thereby causing the spark voltage to be developed across the secondary winding L3, in what is commonly referred to as the beginning of a normal ignition event. As gate G3 changes state, the transistor Q2 is turned off, thereby permitting C1 to begin another positive ramp. During this first mode of operation, the dwell time is relatively long to assure adequate charge time for the primar winding L2 under the lower battery voltage operating condition normally encountered during cranking.

As the engine speed increases, the time that C1 is positively clamped progressively decreases until the second mode of operation is reached. In this mode, which describes the normal operating range of the engine, the turn around of the C1 ramp is commanded by the output of the zero crossing detector before the ramp has had time to reach the positive limit. Once the peak voltage of the ramp is reached, the voltage across C1 instantaneously begins to decrease linearly until the low reference threshold potential of comparator 58 is reached. At this time, a constant ignition coil control signal is generated. In accordance with this invention, because of the constant slope of the downward ramp, this control signal is on for a fixed amount of time regardless of the time required to charge and discharge C1. As in the first mode, the control signal acts to turn on the output device when this preselected voltage is reached. Since the control signal is constant, it serves to optimize the time that the output transistor conducts and thus minimizes the power expended by the system.

As engine speed further increases, as illustrated in FIGS. 5K through 5N, the peak voltage across C1 falls below the value required to operate comparator 58. Since comparator 58 is never activated, the output of the complex ramp generator 14 appearing on conductor 78 remains permanently in the logical one state. In this mode of operation, the output of the zero crossing detector 12 assumes complete control of the ignition function by its control on gate means 18. In this mode of operation, the transition times of the zero crossing detector controls the ratio of on time to off time for the output device 28.

Figure 3:
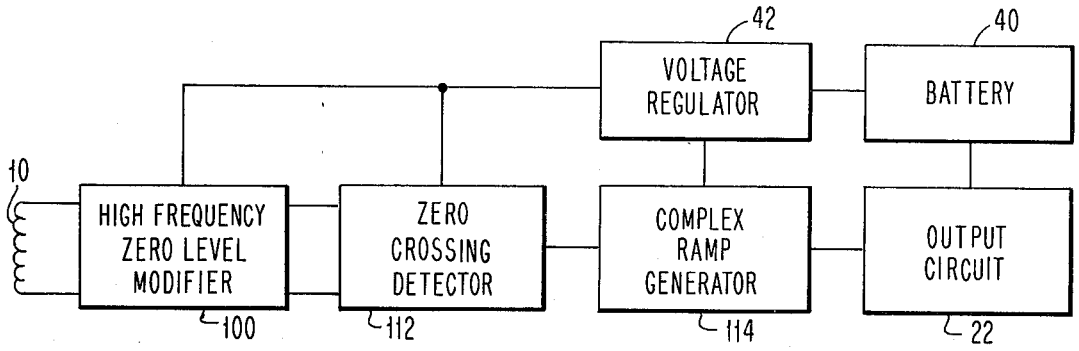
FIG. 3 illustrates a second embodiment of the ignition system of FIG. 1 in schematic block diagram form.
Figure 4:
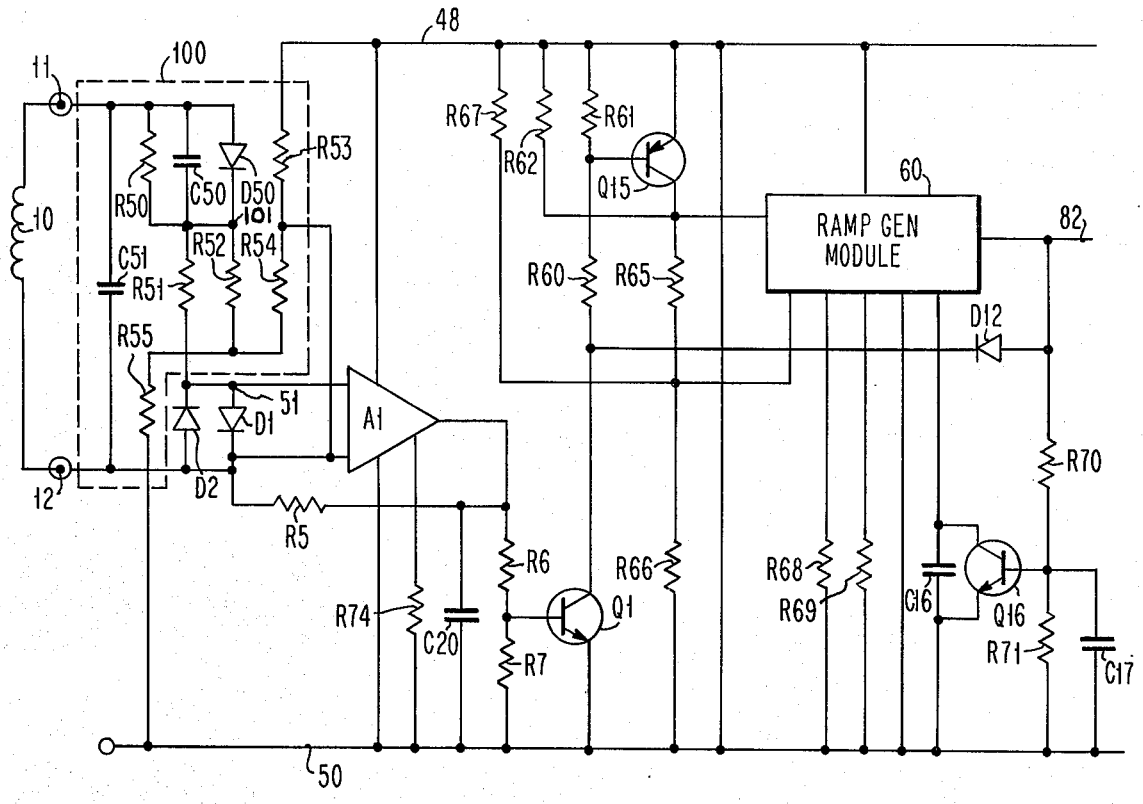
FIG. 4 illustrates in a detailed schematic diagram a portion of the ignition system of FIG. 3.

There is illustrated in FIGS. 3 and 4 of the drawings a second embodiment of a portion of the ignition circuit made in accordance with the present invention. Many of the parts of the ignition system are identical in construction to like parts in the ignition system described above, and accordingly, there has been applied to each component of the ignition system illustrated in FIGS. 3 and 4, a reference numeral that corresponds to the reference numeral applied to the like part of the ignition system described above.

The fundamental difference between the ignition system of FIGS. 3 and 4, and the ignition system described above is the addition of a high frequency zero level modifier circuit, generally designated by the numeral 100 in FIGS. 3 and 4. This embodiment is operative for distributor pickup voltages that are symmetrical in shape, having a negative polarity over 50 percent of the engine cycle and a positive polarity over 50 percent of the cycle. The schematic block diagram of this embodiment is illustrated in FIG. 3 and comprises a distributor pickup coil 10, the high frequency zero level modifier circuit 100, the zero crossing detector 112, the complex ramp generator 114 and the output circuit 22. As in the first embodiment, a battery 40 is connected to the output circuit 22 and a voltage regulator circuit 42 is coupled to the battery 40 for developing a regulated 5 volt direct current potential for application to the zero crossing detector 112 and the ramp generator 114. The high frequency zero level modifier circuit 100 modifies the high frequency mode of operation of the ignition system by varying the reference level of detection as a function of frequency. The circuit 100 includes a resistor R50, a capacitor C50 and a diode D50, each having one end thereof connected in common with one of the terminals 11 of the distributor coil 10. The other end of the elements R50, and D50 are connected to one side of a resistor R52 and the other end of C50 is connected to resistor R51. The other side of resistor R52 is connected to ground through a resistor R55 and also to one side of resistor R54. The other side of R54 is connected to one of the input terminals of operational amplifier A1 and also to the regulated 5 volt supply conductor 48 through resistor R53. R1 provides an impedance match in the input circuit of A1. The resistors R52, R53, R54 and R55 are suitably chosen for biasing the operational amplifier A1 in its linear region of operation and for causing the output level of A1 to be positive when no input signal is applied. The other side of resistor R51 is connected to node 51, at the input of amplifier A1. An input capacitor C51 is connected across the terminals of the distributor pickup coil 10. C51 serves to load the input and to prevent noise from causing false outputs from A1.

In operation, as the distributor pickup voltage goes positive, the diode D50 becomes forward biased, such that the pickup voltage is applied through the resistor R51, and through resistors R52 and R54, to the respective input terminals of the operational amplifier A1. Because the diode D50 conducts for all signals with positive slopes, the high frequency zero level modifier is ineffective. However, as the distributor pickup voltage swings to a negative slope, diode D50 becomes reverse-biased and nonconducting. Consequently, capacitor C50 begins to charge. As capacitor C50 charges, a voltage is applied to the junction 101 through the voltage divider comprising resistors R50 and R51. Accordingly, a new zero threshold is established at the input terminals of the operational amplifier A1. Once the polarity is again reversed, R51 provides a discharge path for the charge accumulated across C50 during the negative path of the cycle. As a consequence of the new zero threshold, the operational amplifier is caused to switch earlier in the wave form.

Functionally, R50, C50 and D50 form a frequency sensitive network which enables the high frequency modifying circuit to generate a synthesized negative zero crossing signal which replaces the true zero crossing signal. Although the input zero reference has been changed with the high frequency modifier circuit, the ignition event has not been changed and remains stable so as to fire at the positive sloped zero crossing.

Since the second embodiment employs a symmetrical distributor pickup voltage, the peak ramp voltage between the positive and negative slopes, occurs at the midpoint of the cycle. Accordingly, the slope modifier network 16 and the reset clamp circuit 24 have been deleted from this embodiment.

The operation of the ignition circuit subsequent to the zero detector 12 is similar to that previously described. More particularly, a switching network comprising the transistor Q15 and its associated biasing resistors R61, R62, R60, R65, R66 and R67 is included to produce a voltage to the comparator 56 within the complex ramp generator 114. A feedback path is provided between the output conductor 82 through a path comprising diode D12 to node 13 and through resistor R60 to the base of Q15. Similarly, biasing resistors R68 and R69 are applied to provide the desired slope of the ramp generator across capacitor C16. Transistor Q16 which is operative in response to output signals applied to conductor 82 appropriately clamps C16 when necessary.

Accordingly, an ignition system has been described which uses only the zero crossing of the alternating voltage input wave forms as reference points in developing the dwell signal. In the system, engine speed information is updated before each ignition event. Thus, on and off times of the output coil are determined on a cycle-to-cycle basis, so as to eliminate degraded performance under transient conditions.

From the above, it can be seen that a close-coupled ignition control system has been described which fulfills all of the objects and advantages set forth above.

While there has been described what are at present considered to be the preferred embodiments of the invention, it will be understood that various modifications may be made therein and it is intended to cover in the appended claims all such modifications as fall within the true spirit and scope of the invention.

What is claimed is:

1. In combination with an engine having an ignition coil and a distributor for supplying an alternating signal, an ignition system comprising:

first means responsive to said alternating signal and operative to generate a first timing signal;

second means responsive to said first timing signal and operative to generate a second timing signal;

third means responsive to said first and second timing signals and operative to generate a constant ignition coil control signal over the normal operating range of said engine so as to effectively minimize the power expended by said ignition system, said control signal having a start transition controlled by said second timing signal and an end transition controlled by said first timing signal; and, fourth means responsive to said control signal and operative to control the charging and discharging of said ignition coil.

2. An ignition system as recited in claim 1 wherein said second means comprises:

a complex wave form generating means responsive to a first transition of said first timing signal and operative to generate an output signal having a first slope, and responsive to a second transition of said first timing signal and operative to change said output signal from said first slope to a second slope;

comparing means responsive to said second slope of said output signal and operative to generate a compare signal when said second slope equals a predetermined value; and fifth means responsive to said compare signal and to said second transitions and operative to generate said second timing signal.

3. An ignition system as recited in claim 1 wherein said first means includes a zero crossing detector.

4. An ignition system as recited in claim 3 including means responsive to the frequency of said alternating signal and operative to vary the detection level of said zero crossing detector as a function of frequency.

5. An ignition system as recited in claim 2 wherein said complex wave form generating means includes a capacitor, a first source of constant current, a second source of constant current and sixth means for selectively connecting said first and said second sources to said capacitor so as to develop said output signal.

6. An ignition system as recited in claim 5 including first resistive means, second resistive means, and seventh means for selectively coupling said first and said second resistive means to said capacitor to form said first and said second slopes.

7. An ignition system as recited in claim 1 wherein said fourth means includes a switchable current source that controls the current applied to said ignition coil and including eighth means responsive to the voltage developed at said ignition coil and operative to switch said switchable current source on when said voltage exceeds a predetermined value.

8. An ignition system as recited in claim 7 wherein said eighth means includes a voltage divider network for attenuating the voltage developed at said ignition coil, a transistor for controlling the operation of said switchable current source, and a zener diode coupled between said voltage divider network and the base of said transistor, said zener diode serving to cause said transistor to conduct when the breakdown voltage of said zener diode is exceeded, whereby conduction of said transistor causes said switchable current source to turn on.

9. An ignition system as recited in claim 8 and including means for biasing said base of said transistor, said biasing means being characterized as having a short time constant, such that said transistor reacts quickly when high voltages are developed at said ignition coil.

10. An ignition system as recited in claim 8 wherein said system further includes a source of bias voltage which is connected to said ignition coil and means responsive to the level of said bias voltage and operative to switch said switchable current source on when said bias voltage exceeds a predetermined value.

* * * * *